US005316600A

United States Patent [19]

Chan et al.

[11] Patent Number: 5,316,600

[45] Date of Patent: May 31, 1994

[54] ENERGETIC BINDER EXPLOSIVE

[75] Inventors: May L. Chan, Ridgecrest, Calif.; Edward M. Roy, Socorro, N. Mex.; Alan Turner, Ridgecrest, Calif.

[73] Assignee: The United States of America as represented by the Secretary of the Navy, Washington, D.C.

[21] Appl. No.: 947,009

[22] Filed: Sep. 18, 1992

[51] Int. Cl.[5] ..... C06B 45/10

[52] U.S. Cl. ..... 149/19.4; 149/19.6

[58] Field of Search ..... 149/19.4, 19.6

[56] References Cited

U.S. PATENT DOCUMENTS

| | | | |
|---|---|---|---|
| 4,025,370 | 5/1977 | Csanady et al. | 149/88 |
| 4,239,561 | 12/1980 | Camp et al. | 149/88 |
| 4,269,637 | 5/1981 | Flanagan | 149/19.6 |
| 4,298,411 | 11/1981 | Godsey | 149/19.4 |
| 4,379,903 | 4/1983 | Reed et al. | 149/19.4 |
| 4,405,534 | 9/1983 | Deisenroth | 149/19.4 |
| 4,601,344 | 7/1986 | Reed et al. | 149/19.6 |
| 4,693,764 | 9/1987 | Curtis | 149/19.4 |
| 4,853,051 | 8/1989 | Bennett et al. | 149/19.4 |
| 4,915,755 | 4/1990 | Kim | 149/19.4 |
| 4,938,813 | 7/1990 | Eisele et al. | 149/19.4 |
| 5,045,132 | 9/1991 | Frankel et al. | 149/19.6 |
| 5,164,521 | 11/1992 | Manzara et al. | 149/19.6 |

*Primary Examiner*—Edward A. Miller

*Attorney, Agent, or Firm*—Harvey A. Gilbert; Melvin J. Sliwka; John Forrest

[57] ABSTRACT

A castable, energetic, plastic-bonded explosive containing glycidyl azide polymer (GAP) an energetic polymer binder combined with the energetic plasticizers trimethyloethane trinitrate (TMETN) and trimethylene glycol dinitrate (TEGDN) or bisdinitropropyl formal and acetal mixture (BDNPF/A), and the explosive solid cyclotetramethylene tetranitramine (HMX) or cyclotrimethylene trinitramine (RDX) having the desirable mechanical properties, insensitivity, and excellent aging properties at much higher solids loading and thus explosive performance than previous compositions. The invention uniquely combines the high energy of high solids loading combined with energetic polymers and plasticizers to provide the insensitivity of rubbery explosive compositions.

3 Claims, No Drawings

ENERGETIC BINDER EXPLOSIVE

FIELD OF THE INVENTION

The present invention relates to high performance explosives and in particular to energetic binder explosives using mixed plasticizers and having high solids loading capacity and operational handling insensitivity.

BACKGROUND OF THE INVENTION

Recent progress in explosive technology has been in the area of cast-cured, plastic bonded explosives (PBX). Explosives development efforts have produced a number of successful rubbery energetic PBX compositions. These PBX compositions demonstrate better safety and vulnerability characteristics than TNT-based melt-cast compositions. There is, however, an increasing need to significantly improve the performance of PBX materials, particularly for specific types of warhead applications. Currently, energetic but sensitive explosive materials are used in high performance shaped-charge weapon systems. Much concern has been raised over the ability of these sensitive explosives, when used in weapon systems, to meet insensitive munitions requirements. Typical plastic-bonded explosives contain binders of inert polymers. While the inert binders desensitize the hazardous explosive solid ingredient with which they are mixed, they also diminish or degrade the useful explosive energy. When inert polymers are replaced by energetic polymers in the composition, performance is enhanced due to the additional chemical energy provided by these energetic polymers. As the energetic binder content is increased, the tetranitramine level of crystalline explosive filler such as cyclotetramethylene tetranitramine (HMX) is reduced. The resulting transfer of energy releasing groups from the solid phase to the soft polymeric binder phase results in a more favorable tradeoff between performance and hazard properties than now exists with conventional PBX's using inert polymers.

Considerable effort has been expended in developing energetic polymers Among the recent successes in development of energetic polymers for binder application is glycidal azide polymer (GAP).

GAP is an energetic polymer which is essentially a honey-like, pourable, viscous material. It requires a liquid plasticizer to reduce its viscosity to achieve the high solids loading required for energetic compositions. Insensitive high explosive formulations containing GAP, HMX and a single plasticizer are known. For example, trimethylolethane trinitrate (TMETN) a friction sensitive energetic plasticizer has been used in GAP/HMX formulations which have an unfavorable embrittlement problem at low temperature ($< -20°$ F.). These single plasticizer formulations are limited to about 70% to 75% by weight of explosive solids. Additionally, processing of single plasticizer formulations containing GAP and high weight percentages of solids is difficult because of the high viscosity and flow properties of GAP.

SUMMARY OF THE INVENTION

It is thus an object of the present invention to develop a high performance, high energy, insensitive explosive.

It is further an object of the present invention to provide a plastic bonded explosive having better safety and vulnerability characteristics than predecessor compounds.

It is additionally another object of the present invention to provide a plastic bonded explosive utilizing an energetic polymer as a binder in lieu of inert polymers.

Thus the present invention is a castable, energetic plastic-bonded explosive containing glycidal azide polymer (GAP) binder which cures to a rubbery composition in the presence of a combination of trimethylolethane trinitrate (TMETN) and trimethylene glycol dinitrate (TEGDN) or Bisdinitropropylformal and acetal mixture (BDNPF/A), energetic plasticizers and the explosive solid cyclotetramethylene tetranitramine (HMX) or cyclotrimethylene trinitramine (RDX). The mixed energetic plasticizers greatly improve the explosive and the flow properties of the plastic-bonded explosive of the present invention allowing higher solids loading while maintaining the desirable elastomer properties achieved at lower solids loading.

The formulation of the present invention has the advantage of higher solids loading which increases the energy of the explosive composition. The invention formulation maintains the desired mechanical properties of previous compositions at much higher solids loading than previous compositions and additionally has excellent aging properties.

DETAILED DESCRIPTION

The present invention combines the energetic plasticizer trimethylolethane trinitrate (TMETN) and triethyleneglycol dinitrate (TEGDN), or bisdinitropropylformal and acetal mixture (BDNPF/A) which produce a substantial and favorable effect on the viscosity and flow properties of GAP/HMX or GAP/RDX compositions. GAP/HMX and GAP/RDX compositions containing about 10% by weight TMETN plasticizer have a yield stress of about 100 dynes/cm$^2$ as measured by a Haake viscometer. When a mixture of 8% by weight TMETN and 2% by weight TEGDN or BDNPF/A plasticizer is used, the yield stress drops by 50% to about 50 dynes /cm$^2$. this drop in yield stress is significant because it allows processing of GAP/HMX and GAP/RDX mixes with solid loads as high as 80% by weight of HMX or RDX.

Moreover, the mixed plasticizers maintain the desirable elastomeric properties achieved at lower solids loading. As a result, the present invention uniquely combines the high energy of high solids loading and energetic polymers with the insensitivity of rubbery compositions. Test results indicated that the formulation of the present invention has a better combination of performance and vulnerability characteristics, than any other cast PBX available.

The preferred formulation of the present invention is as follows:

| Ingredient | Weight % |
|---|---|
| HMX Class A (or RDX) | 60.00 ± 10.00 |
| HMX Class E (or RDX) | 20.00 ± 5.00 |
| The total solid loading is, however, limited to | 80% ± 2% |
| GAP | 8.00 ± 1.0 |
| N-100, or HMDI, or IPDI | 1.00 ± 0.5 |
| TMETN | 8.05 ± 1.0 |
| TEGDN (or BDNPF/A) | 2.00 ± 0.5 |
| MNA and 2-NDPA | 0.3 ± 0.5 |
| TPB or octanoic acid | 0.1 ± 0.2 |

The above ingredients are:

(HMX) cyclotetramethylene-tetranitramine or (RDX) Cyclotrimethylene-trinitamine, as the explosive filler;

(GAP) glycidyl azide polymer, as an energetic binder;

(N-100) multifunctional isocyanate, as a curative;

Hexamethylene diisocyanate (HMDI), as a curative;

Isophorone diisocyanate (IPDI), as a curative;

trimethylolethane trinitrate, an energetic plasticizer (TMETN);

Trimethylene glycol dintirate (TEGDN) or bisdinitropropylformal and acetal mixture (BDNPF/A) as an energetic plasticizer;

N-methyl-4-nitroaniline (MNA), a stabilizer;

2-Nitrodiphenylamine (2-NDPA), a stabilizer.

Triphenyl bismuth TPB, a cure catalyst and

Octanoic acid, a cure catalyst.

The method of manufacture of the explosive of the present invention was as follows:

The GAP polymer, the plasticizers TMETN and TEGDN or BDNPF/A were added to the mixing bowl of a vertical shear mixer. The explosive solid HMX or RDX was added incrementally with coarse (class A) and fine (class E) solids alternating in sequence. The MNA stabilizer and 2-NDPA stabilizer were added next. All mixing was performed at 140° F.±5° F. with less than 5 mm Hg of vacuum. The curative N-100 (or HMDI or IPDI) was added after all the solid additions were complete. Cure catalysts TPB and octanoic acid were added last. The mixing continues for about another thirty (30) minutes and the flowable explosive mixture is vacuum cast into test or operating configuration hardware. The explosive, when mixed according to the procedure described herein has excellent processing characteristics with less than 10 kp (110° F.) at the end of mix and it flows with slight mechanical vibration. In preparing test samples three (3) to five (5) days of curing in an oven at 120° F.±10° F. was accomplished.

The mechanical properties of the explosive of the present invention are:

| | |
|---|---|
| Impact sensitivity (50% pt., 2.5 kg) cm | 17–19 |
| GAP test (cards) NOL | 170 |
| Density g/cc | 1.74 |

-continued

| | |
|---|---|
| Friction sensitivity (no fires @ 1000 lbs) | 20/20 |
| Electrostatic sensitivity (no fires @ 0.25J) | 20/20 |
| Vacuum Thermal Stability (48 hrs @ 100° C.) ml/g | 0.28 |
| Self heating (crit. temp) °C. | 165 |
| Detonation Velocity mm/μs | 8.36 |
| Glass Transition Temperature ($T_g$) | −55° C. |

The Calculated Performance of the explosive of the present invention is:

| | |
|---|---|
| Detonation Pressure Kbar | 309 |
| Detonation Velocity mm/μs | 8.4 |
| Cylinder Expansion energy @ 6 mm (KJ/g) | 1.17 |
| Cylinder Expansion energy @ 19 mm (KJ/g) | 1.47 |

Modifications and variations of the present invention are possible in light of the above teachings. It is, therefore, to be understood that within the scope of the claims which follow that the invention may be practical otherwise than as specifically described herein.

What is now claimed as the invention is:

1. A castable explosive composition consisting essentially of about 80% by weight of an explosive solid selected from the group consisting of cyclotetramethylene tetranitramine (HMX) and cyclotrimethylene trinitromine (RDX); 8%±1% weight percent Glycidyl Azide Polymer (GAP); 1.0±0.5 weight percent of a curative selected from the group consisting of multifunctional isocyanate (N-100), hexamethylene diisocyanate (MHDI), and isophorone diisocyanate (IPDI); 8.05±1.0 weight percent Trimethylolethane trinitrate (TMETN); and 2.00±0.5 weight percent of an energetic plasticizer selected from the group consisting of Trimethylene glycol dinitrate (TEGDN), bisdinitropropyl formal and acetal mixture (BDNPF/A).

2. The castable explosive composition of claim 1 further consisting essentially of stabilizer selected from the group consisting of 0.3–0.5 weight percent N-Methyl-4-nitroaniline (MNA) and 0.1–0.2 weight percent 2-Nitrodiphenylamine (2-NDPA).

3. The castable explosive composition of claim 1 further consisting essentially of a cure catalyst selected form the group consisting of 0.05–0.15 weight percent octanoic acid and 0.03 to 0.05 2,5-Dinitrosalicylic acid (DNSA).

* * * * *